US007360918B2

(12) United States Patent
Trombetta et al.

(10) Patent No.: US 7,360,918 B2
(45) Date of Patent: Apr. 22, 2008

(54) HIGH-EFFICIENCY SOLAR-CHARGING LED WINDOW CANDLE

(76) Inventors: Vince Trombetta, 4130 Homedale Rd., Sykesville, MD (US) 21874; Kevin Trump, 620 Jasontown Rd., Westminster, MD (US) 21158

( * ) Notice: Subject to any disclaimer, the term of this patent is extended or adjusted under 35 U.S.C. 154(b) by 97 days.

(21) Appl. No.: 11/361,693

(22) Filed: Feb. 24, 2006

(65) Prior Publication Data

US 2006/0192503 A1 Aug. 31, 2006

Related U.S. Application Data

(60) Provisional application No. 60/656,452, filed on Feb. 28, 2005.

(51) Int. Cl.
*F21L 19/00* (2006.01)

(52) U.S. Cl. ..... 362/161; 362/810; 362/806; 362/566; 362/183

(58) Field of Classification Search ..... None
See application file for complete search history.

(56) References Cited

U.S. PATENT DOCUMENTS

| | | | | |
|---|---|---|---|---|
| 4,866,580 | A | 9/1989 | Blackerby | |
| 5,041,952 | A | 8/1991 | Janda et al. | |
| 5,152,602 | A | 10/1992 | Boschetto | |
| 5,271,594 | A * | 12/1993 | Djelouah | 248/523 |
| 5,601,360 | A * | 2/1997 | Paquette | 362/653 |
| 5,980,064 | A | 11/1999 | Metroyanis | |
| 6,616,308 | B2 | 9/2003 | Jensen et al. | |
| 2004/0037069 | A1 * | 2/2004 | Blackbourn | 362/161 |
| 2004/0252492 | A1 * | 12/2004 | Peterson | 362/183 |

* cited by examiner

*Primary Examiner*—Sharon E. Payne
*Assistant Examiner*—Kristen A Manskar
(74) *Attorney, Agent, or Firm*—Ober/Kaler; Royal W. Craig

(57) ABSTRACT

Disclosed herein is an improved high-efficiency solar-charging electric window candle comprising a base adapted to sit securely upon a window sill. The base includes a footer formed with a battery compartment accessible through a bottom hatch, and a riser protruding upwardly from the footer with upwardly inclined side surfaces. The riser also has a compartment for enclosing a circuit board, and a vertically-oriented collar. A rechargeable battery is mounted in the footer of said base, and a hollow cylindrical candle body is inserted in the collar of the base riser, and a bulb assembly comprising a white LED is mounted atop the candle body. A circuit board is enclosed in the riser and includes two circuits: a current pump for supplying a pulsed current, and a photosensing circuit for sensing ambient light levels. The charge pump circuit reduces current requirements of the white LED, and the photosensing circuit automatically detects ambient light levels and illuminates the white LED while disconnecting the rechargeable battery, or vice versa, depending on whether there is sufficient ambient light.

14 Claims, 4 Drawing Sheets

HIGH-EFFICIENCY SOLAR-CHARGING LED WINDOW CANDLE

CROSS-REFERENCE TO RELATED APPLICATION(S)

The present application derives priority from U.S. provisional application no. 60/656,452 filed Feb. 28, 2005.

BACKGROUND OF THE INVENTION

1. Field of the Invention

The present invention relates to decorative candle lighting systems and, more particularly, to a battery-powered solar-recharging electric candle lighting system for use in a window sill.

2. Description of the Background

There has long been a widespread Christmas tradition of placing candles in windows. Many believe that this tradition dates back to early Christianity. The custom exists in several European countries including France, England, Ireland and Denmark.

The first of the 13 original colonies, Virginia, takes credit for adopting the tradition in the USA. In colonial Virginia a candle in the window was a gesture of welcome and a promise of warm hospitality to guests. While the meaning may have faded, the candle in the window is still a widespread US custom, at least for decorative purposes.

Unfortunately, flame candles pose a fire hazard. Consequently, some have endeavored to build electric window candles. There have been many technological advancements toward this end. For example, batteries can now produce higher current outputs for longer periods of time, and with less recharging time. Still, it takes a large amount of power to light an incandescent window candle all night, and no existing battery can achieve this. There have been various approaches to dealing with the power requirements. Some limit the on-time. For example, U.S. Pat. No. 5,152,602 to Boschetto shows an electric candle with an electrical circuit for sensing ambient light conditions and automatically turning on and off the electric candle. The sensor for the electrical circuit is located within the translucent candlestick.

Others use lower-voltage lamps. For example, U.S. Pat. No. 4,866,580 to Blackerby issued Sep. 12, 1989 shows a self-powered ornamental lighting device includes a housing with a power source in the housing chamber. One or more LEDS are mounted in the housing.

Still others recharge by solar power. U.S. Patent Application 20040252492 by Peterson shows a self-charging electric candle. A rechargeable battery is coupled to both the light source and to a solar photoelectric cell. The rechargeable battery supplies electricity to the light source and is recharged by the photoelectric cell. The solar-rechargeable concept makes excellent sense. After all, the candle sits on a window sill all day. However, even with a full charge the candle burns only 4-5 hours.

It would be mush more advantageous to provide a high-efficiency solar-charging LED window candle that remains off while charging during the day, and illuminates at night, all night.

SUMMARY OF THE INVENTION

It is, therefore, the primary object of the present invention to provide an aesthetically-pleasing high-efficiency solar-charging LED window candle that remains off while charging during the day, and illuminates at night, all night.

It is another object to provide a high-efficiency solar-charging LED window candle capable of illuminating a white LED for 24-48 hours using a single charge from an efficient rechargeable battery pack with NiCad 1.2 volt rechargeable batteries.

It is still another object to provide a light bulb assembly in which a white LED is mounted inside a glass bulb to realistically simulate a window candle.

It is still another object to provide dual (front and back) inclined solar cells for more efficient charging, and a photosensing circuit that employs the existing solar cells to sense ambient light, for automatically turning the power to the LED off during the day and on at night, effectively allowing the device to charge all day and illuminate all night.

It is still another object to power the white LED by a charge pump circuit for reducing the current requirements of the LED without sacrificing brightness or aesthetics.

These and other objects are accomplished with the improved high-efficiency solar-charging LED window candle of the present invention, which generally comprises a narrow base adapted to sit securely upon a window sill, the base being formed with a battery compartment accessible through a bottom hatch, and a riser section protruding upwardly with inclined side surfaces, the riser also being formed with a compartment for enclosing circuitry, and a vertically-oriented collar for receiving a candle body. Dual (front and back) solar cells are mounted on the inclined surfaces of the riser for recharging the battery during the day from solar light, and at night from inside lighting. This configuration yields an aesthetically pleasing appearance, plus the solar cells are mounted along a steep incline for better light collection. The candle body comprises a cylindrical length of white plastic compression-fit into the collar and extending upward approximately one foot to a screw-in bulb receptacle (in this case the receptacle is not wired). A light bulb assembly is screwed into the bulb receptacle, the light bulb assembly comprising a glass light-bulb housing enclosing a white LED with shielded leads. The glass light-bulb housing is essentially an incandescent candle light bulb with glass candle-shaped bulb secured to a screw-threaded male base, but the base is tapped to remove the filament. Instead, the leads of the white LED are connected upward through the tapped base and the LED is mounted where the filament normally sits. The LED is connected to a circuit board residing in the riser of the base. A photosensing circuit resides on one circuit board, and this measures the current output from the two solar cells to sense ambient light, for automatically turning the power to the LED off during the day and on at night, effectively allowing the device to charge all day and illuminate all night. The circuit board also contains a charge pump circuit for reducing the current requirements of the LED without sacrificing brightness or aesthetics. This allows illumination of a white LED (characteristically high current drain) for an astounding 24-48 hours between charges.

The present invention's design is simple and straightforward, and can be economically manufactured.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is an improved high-efficiency solar-charging LED window candle that is battery powered and solar-charging. The electric candle charges during the day and automatically illuminates after dark.

Figure 1:
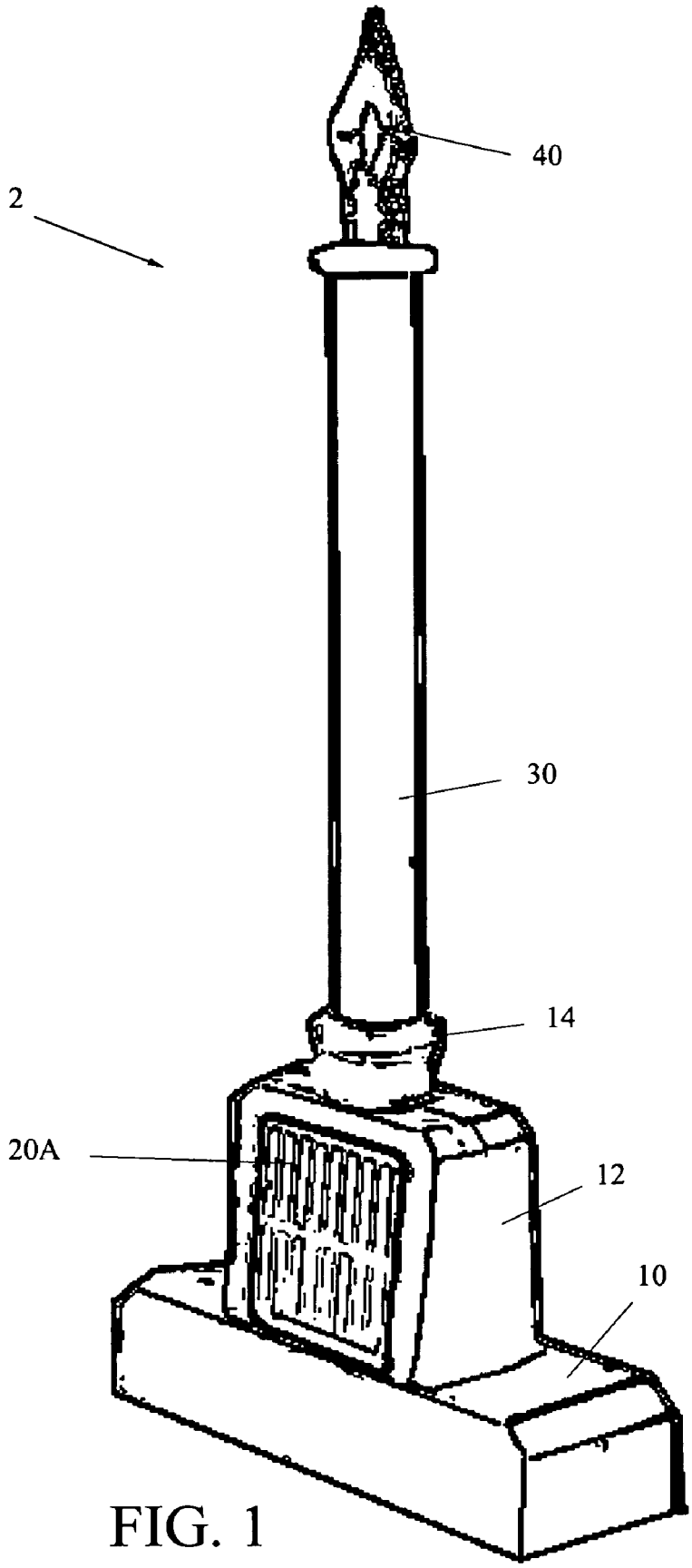
FIG. 1 is a perspective view of the high-efficiency solar-charging LED window electric candle 2 according to the present invention.

Referring to FIG. 1 a preferred embodiment of electric candle light 2 is shown. The electric candle light 2 has a decorative base 10 formed of wood or the like. The base 10 is approximately 5" long and 2" wide so that it can fit on a standard window sill of a house window. Base 10 is hollow and accessible through a removable panel in the bottom for insertion of a NiCad battery pack. A riser 12 extends upwardly from the base 10, the riser 12 being formed substantially hollow with a central enclosure (obscured) for seating the circuit board of the present invention. The riser 12 is also formed with inclined recesses in the front and rear for mounting opposing solar cells at an angle, and a vertically-oriented collar 14 at the top for receiving a candle body 30. The recesses are substantially rectangular indentations each with a marginal lip for flush seating of the solar cells, and they open rearward into the enclosure within riser 12. Dual (front and back) solar cells 20A & 20B are mounted along an incline, seated flush in the front and back recesses of the riser 12, one on each side, for recharging the battery during the day from solar light, and at night from inside lighting. This configuration yields an aesthetically pleasing appearance, plus the solar cells 20A & 20B are mounted at an inclined angle for more efficient light collection.

The candle body 30 comprises a cylindrical length of white plastic that appears as a wax candle, compression-fit into the collar 14 and extending upward approximately one foot to a screw-in bulb assembly 40. The bulb assembly comprises a glass light-bulb housing enclosing a white LED with shielded leads (as will be described) running down to the circuit board. The battery pack is preferably a NiCad dual cell rechargeable battery pack stowed in the bottom of base 10 and accessible through the removable panel on the bottom. The battery pack is wired up to the circuit board 52 resident in the enclosure in riser 12.

Figure 2:
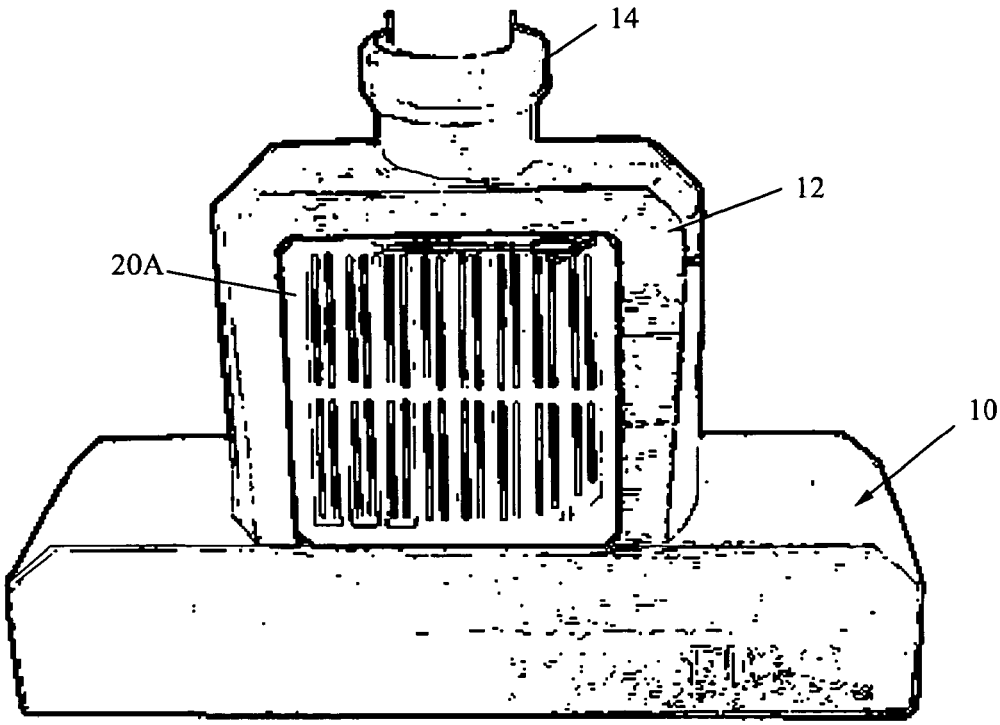
FIG. 2 is a front view of the base 10.

FIG. 2 is a front view of the two-tier base 10 inclusive of elongate footer, and upper-tier riser 12 leading to collar 14. It can be seen that the foregoing configuration has an aesthetically pleasing appearance, and the inclined front and back planes of riser 12 seats the dual solar cells 20A & 20B at a distinct angle in a range of from 5-15 degrees offset from vertical to provide maximum light collection capabilities for both indoor and outdoor light.

Figure 3:
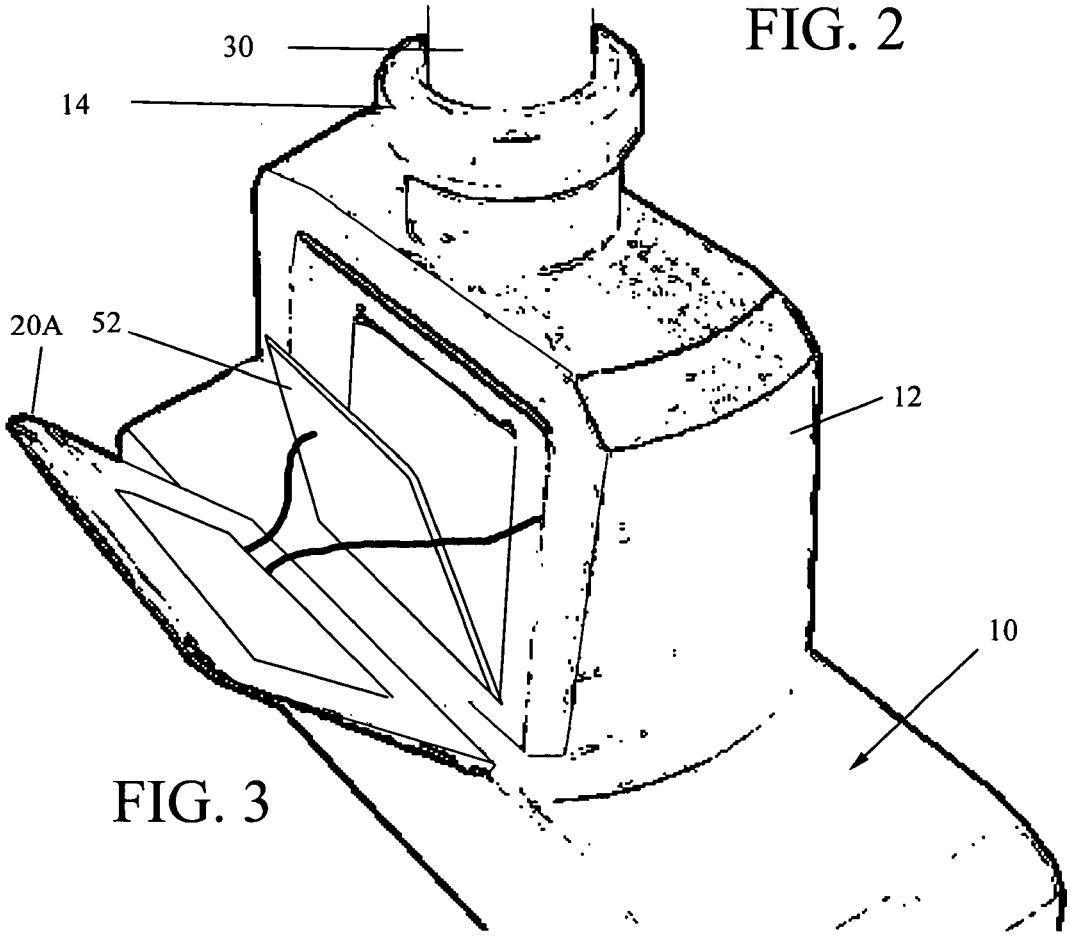
FIG. 3 is a front view of the base 10 with solar cell 12A partially removed to expose the internal circuit board 52.

FIG. 3 is a front view of the base 10 with solar cell 12A partially removed to expose the circuit board 52 of the present invention. Circuit board 52 contains two circuits, inclusive of a photosensing circuit to measure the current output form the two solar cells 12A & 12B to sense ambient light, for automatically turning the power to the LED off during the day and on at night, effectively allowing the device to charge all day and illuminate all night. The second circuit on circuit board 52 is a charge pump circuit for reducing the current requirements of the LED without sacrificing brightness or aesthetics. This allows illumination of a white LED (characteristically high current drain) for an astounding 24-48 hours between charges.

Both circuits on circuit board 52 are mounted inside the enclosure in riser 12 and are covered by the solar cells 12A & 12B, which are seated in the inclined side surfaces of riser 12 at the above-described angle of approximately 5-15 degrees offset from vertical. One skilled in the art will readily understand that the solar cells 12A & 12B themselves are circuit-board mounted devices, and that it is possible to custom manufacture the solar cells 12A & 12B with integral photosensing circuit and/or charge pump circuit mounted rearwardly thereon, thereby conserving space or eliminating the need for circuit board 52.

Figure 4:
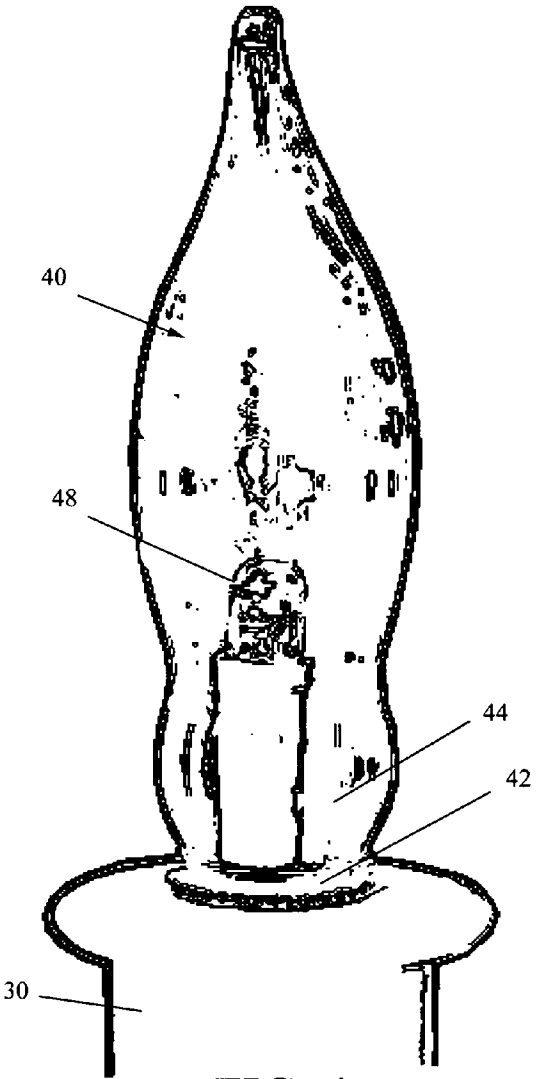
FIG. 4 is a close-up view of the glass light-bulb housing 40.

FIG. 4 is a close-up view of the glass light-bulb housing 40 which is essentially an incandescent candle light bulb with glass candle-shaped bulb 44 secured to a screw-threaded male base 42, the base 42 having been previously tapped to remove the filament. In its place, the insulated leads 46 of the white LED 48 are connected upward through the tapped base 42.

Figure 5:
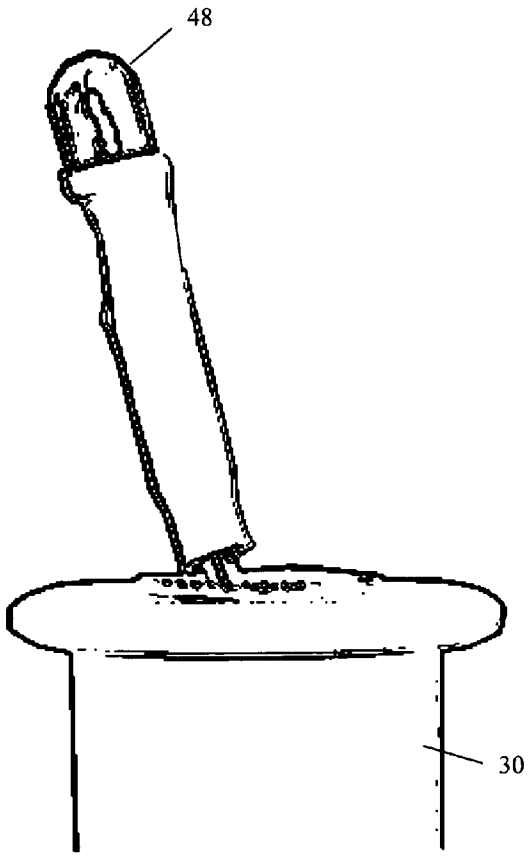
FIG. 5 is a close-up view of the LED 48 protruding upward through the screw-threaded male base 42.

FIG. 5 is a close-up view of the LED 48 protruding upward through the screw-threaded male base 42, candle-shaped bulb 44 removed, and the LED 48 being mounted where an incandescent filament would normally sit. The LED 48 is connected to the circuit board 52 residing in the riser 12 of the base 10, and on to the battery pack.

Figure 6:
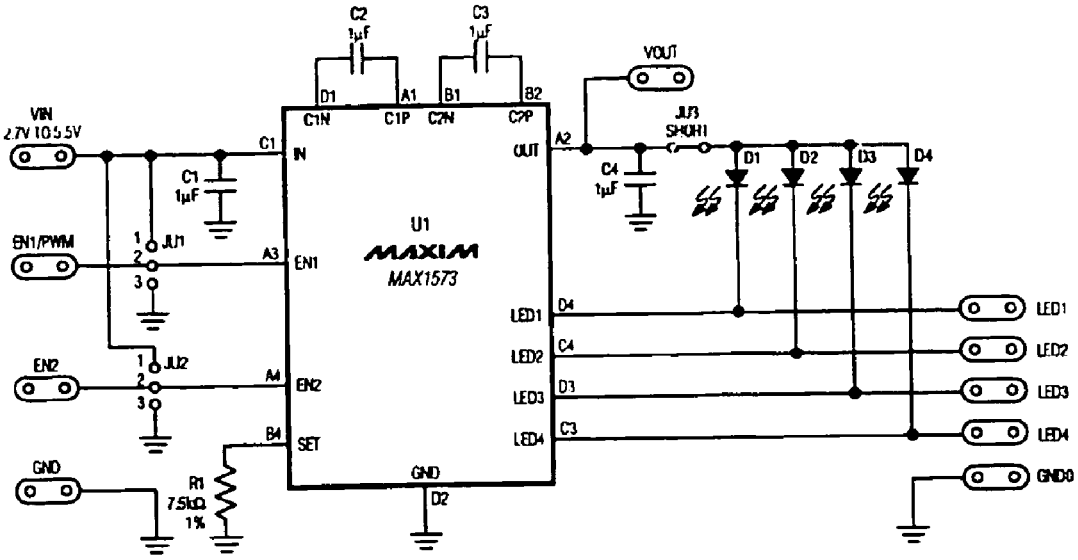
FIG. 6 is a schematic diagram of the first current pump circuit on circuit board 52.

FIG. 6 is a schematic diagram of the first circuit on circuit board 52 which is a charge pump circuit for reducing the current requirements of the LED without sacrificing brightness or aesthetics. This first circuit comprises a Maxim (tm) EV surface-mount circuit board kit incorporating a white MAX1573(tm) driver IC with a high-efficiency charge pump. The EV kit accepts a 2.7V to 5.5V input voltage and is coupled at Vin to the battery pack. The Maxim EV kit is capable of driving up to 4 white LEDs with regulated constant current for uniform intensity. The MAX 1573 runs at 1 MHz fixed frequency, with a default output LED current set to 17 mA (to set a different LED current, R1 can be changed). The present invention employs a single LED 48, and so this is coupled at LED1, and the spare LED pad(s) are connected to the input voltage (and are not left floating).

Figure 7:
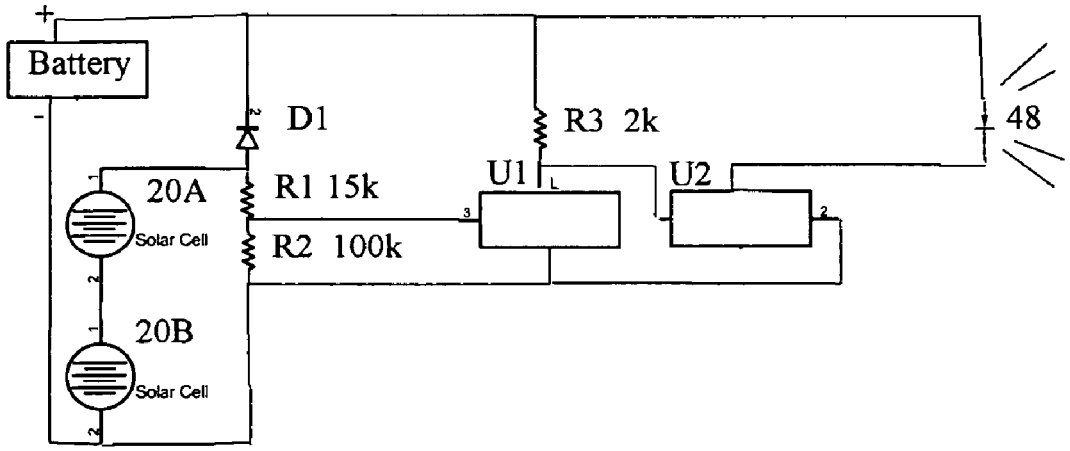
FIG. 7 is a schematic of the second photosensing circuit on circuit board 52.

FIG. 7 is a schematic of the second circuit on circuit board 52 which is a photosensing circuit for measuring the current output from the two solar cells 12A & 12B to sense ambient light, for automatically turning the power to the LED 48 off during the day and on at night, effectively allowing the device to charge all day and illuminate all night. The photosensing circuit on circuit board 52 is an analog circuit which simply couples the two solar cells 12A & 12B in series to generate a voltage which is proportional to the amount of sunlight and/or other ambient light hitting them. The voltage is applied across a pair of op-amps, both of which may be supplied on one LM324 Low Power Quad Operational Amplifier from National Semiconductor, which depending on the threshold current from solar cells 12A & 12B selectively turns on LED 48 when there is no ambient light for charging, or turns it off when there is light. When the level of ambient light surpasses a predetermined minimum value, it can be assumed that it is daylight. The photosensing circuit on circuit board 52 automatically detects that the level of light has dropped below a threshold level, turns the electric candle LED 48 "on ", causing LED 48 to illuminate. Conversely, the photosensing circuit disconnects the LED 48 from the rechargeable batteries when there is light to allow charging of the batteries. Thus, the electric candle 2 thereby automatically turns off during daylight hours and allows the batteries to recharge. One skilled in the art will understand that an optional control may be provided so that a homeowner can selectively adjust the threshold of the photosensing circuit board 52.

An optional manual on/off switch (not shown) is preferably also provided that selectively connects and disconnects the LED 48 to allow the homeowner to turn the candle 2 off manually as desired during selected hours of the evening.

The above-described circuit board 52 inclusive of the first current pump circuit and second photosensing circuit combine to allow constant non-flickering illumination of a white LED 48 (white LEDs have a characteristically high current drain) for an astounding 24-48 hours between charging.

In use, the electric candle light 2 is placed on the sill of a window so that the LED 48 light can be observed from the outside of the window. Most all windows have some type of lower sash that extends upwardly and obstructs at least part of the candle base 10 sitting on the sill. The riser 12 of the present invention elevates the solar cells 12A & 12B over the sash, so that either cell 12A & 12B can collect light passing through the window, and exposes them at an angle for better exposure to the sun (or to interior lighting).

The battery pack in the base 10 of the electric light candle 2 adds ballast and creates a low center of gravity that makes the electric light candle 2 stable on a narrow window sill. The present design is simple and straightforward, and can be economically manufactured.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A high-efficiency solar-charging electric window candle, comprising:

a base adapted to sit securely upon a window sill, said base including a footer formed with a battery compartment accessible through a lower hatch, and a riser protruding upwardly from said footer with at least one upwardly inclined plane, said riser also being formed with a compartment for enclosing a circuit board, and a vertically-oriented collar for supporting a candle body; a rechargeable battery mounted in the footer of said base;

a candle body comprising a hollow cylinder inserted in the collar of said base riser, said candle body having a receptacle at an upper end; a bulb assembly comprising an LED mounted in a light-bulb housing including a glass enclosure attached to a base for insertion in the receptacle of said candle body; at least one solar cell mounted along the at least one inclined plane of said riser for recharging the battery from ambient light;

a circuit board enclosed in said riser and including a first current pump circuit means for supplying a pulsed current to said LED from said battery to reduce current requirements of the LED without sacrificing brightness or aesthetics to provide battery-powered illumination of said LED within a range of from 24-48 hours without charging, and a second photosensing circuit connected to said solar cell for sensing ambient light levels there from;

wherein said photosensing circuit automatically detects that ambient light levels have dropped below a threshold level, thereon illuminating said LED, and disconnecting said LED from the rechargeable battery when ambient light levels exceed said threshold level to allow said battery to recharge.

2. The high-efficiency solar-charging electric window candle according to claim 1, wherein said LED is a white LED.

3. The high-efficiency solar-charging electric window candle according to claim 2, wherein said first current pump circuit means in combination with said second photosensing circuit allows illumination of said white LED for 24-48 hours using a single charge.

4. The high-efficiency solar-charging electric window candle according to claim 3, wherein said rechargeable battery is a NiCad battery pack mounted in the footer of said base.

5. The high-efficiency solar-charging electric window candle according to claim 1, wherein said bulb assembly comprises an incandescent candle light bulb with glass candle-shaped bulb secured to a screw-threaded male base, the base having been tapped to remove the incandescent filament.

6. The high-efficiency solar-charging electric window candle according to claim 1, wherein said riser protrudes upwardly from said footer and said at least one upwardly inclined plane as disposed at an offset angle from vertical within a range of from 5-15 degrees.

7. The high-efficiency solar-charging electric window candle according to claim 6, wherein said riser is formed with a recess having an inner lip for flush inclined seating of said at least one solar cell.

8. A high-efficiency solar-charging electric window candle, comprising:

a base adapted to sit securely upon a window sill, said base including a footer formed with a battery compartment accessible through a lower hatch, and a riser protruding upwardly from said footer along opposing inclined planes, said riser also being formed with a compartment for enclosing a circuit board, and a vertically-oriented collar for supporting a candle body; a rechargeable battery mounted in the footer of said base;

a candle body comprising a hollow cylinder inserted in the collar of said base riser, said candle body having a receptacle at an upper end;

a bulb assembly comprising an LED mounted in a light-bulb housing including a glass enclosure attached to a base for insertion in the receptacle of said candle body;

a pair of solar cells each mounted along a corresponding one of said inclined planes of said riser for recharging the battery from ambient light;

a circuit board enclosed in said riser and including a first current pump circuit means for supplying a pulsed current to said LED from said battery to reduce current requirements of the LED without sacrificing brightness or aesthetics to provide battery-powered illumination of said LED within a range of from 24-48 hours without charging, and a second photosensing circuit connected to said solar cell for sensing ambient light levels therefrom;

wherein said photosensing circuit automatically detects that ambient light levels have dropped below a threshold level, thereon illuminating said LED, and disconnecting said LED from the rechargeable battery when ambient light levels exceed said threshold level to allow said battery to recharge.

9. The high-efficiency solar-charging electric window candle according to claim 8, wherein said LED is a white LED.

10. The high-efficiency solar-charging electric window candle according to claim 9, wherein said first current pump circuit means in combination with said second photosensing circuit allows illumination of said white LED for 24-48 hours using a single charge.

11. The high-efficiency solar-charging electric window candle according to claim 10, wherein said rechargeable battery is a NiCad battery pack mounted in the footer of said base.

12. The high-efficiency solar-charging electric window candle according to claim 8, wherein said bulb assembly comprises an incandescent candle light bulb with glass candle-shaped bulb secured to a screw-threaded male base, the base having been tapped to remove the incandescent filament.

13. The high-efficiency solar-charging electric window candle according to claim 8, wherein said riser protrudes upwardly from said footer and said opposing upwardly inclined planes are both inclined at an offset angle from vertical within a range of from 5-15 degrees.

14. The high-efficiency solar-charging electric window candle according to claim 13, wherein said riser is formed with opposing recesses within said opposing upwardly inclined planes, each recess having an inner lip for flush inclined seating of a corresponding one of said pair of solar cells.

* * * * *